US008070696B2

(12) United States Patent
Cui

(10) Patent No.: US 8,070,696 B2
(45) Date of Patent: Dec. 6, 2011

(54) MYOPIA THERAPY APPLIANCE AND A BLINDER WITH SAID APPLIANCE

(76) Inventor: Jianjun Cui, Shandong (CN)

( * ) Notice: Subject to any disclaimer, the term of this patent is extended or adjusted under 35 U.S.C. 154(b) by 832 days.

(21) Appl. No.: 10/593,052

(22) PCT Filed: Apr. 15, 2004

(86) PCT No.: PCT/CN2004/000355

§ 371 (c)(1),
(2), (4) Date: Jun. 5, 2007

(87) PCT Pub. No.: WO2005/087157

PCT Pub. Date: Sep. 22, 2005

(65) Prior Publication Data

US 2008/0161732 A1 Jul. 3, 2008

(30) Foreign Application Priority Data

Mar. 16, 2004 (CN) ..... 2004 20 0392546

(51) Int. Cl.
*A61H 7/00* (2006.01)

(52) U.S. Cl. ..... 601/13

(58) Field of Classification Search ..... 601/6–14, 601/37; 600/398–406; 604/294, 295, 301, 604/302

See application file for complete search history.

(56) References Cited

U.S. PATENT DOCUMENTS 67,832 A * 8/1867 Winslow ..... 601/13
79,847 A * 7/1868 Maltby ..... 601/13
852,827 A * 5/1907 Dorment ..... 601/13

(Continued)

FOREIGN PATENT DOCUMENTS

CA 2189828 A1 5/1998

(Continued)

OTHER PUBLICATIONS

English Translation of Foreign Patent CN 2430152, 4 pages, May 16, 2001.

(Continued)

*Primary Examiner* — Kristen Matter
(74) *Attorney, Agent, or Firm* — Hasse & Nesbitt LLC; Daniel F. Nesbitt

(57) ABSTRACT

The invention relates to a myopia prophylactic and therapy appliance, which includes a suction head and a handle. The end of the suction head is in the form of a round flat opening. A blowhole is set on the wall of the handle. During the course of using the appliance, first, put the suction head snugly on the eyeball in order to vent the air of the suction head. Then, negative pressure is produced in the suction head by nipping the blowhole. When a hand grasps, or nips, the blowhole, a negative air pressure is produced. The handle is then pushed and pulled resulting in the suction head tip attracting the eyelid and eyeball and causing same to move back and forth. The suction head sucks the eyelid and the eyeball, and moves forward and backward by pulling forward and pushing backward the handle. Because the eyeballs are controlled by 6 extraoculars, when they are pulled and pushed, there will be a little distortion of the eyeballs. With this distortion, there will be a strong massage to the ciliary muscle. So the ciliary muscle will relax and get back to regulate normally. Then the eyes will relieve, so the utility model is convenient and effective.

7 Claims, 1 Drawing Sheet

U.S. PATENT DOCUMENTS

| | | | | |
|---|---|---|---|---|
| 893,021 | A | 7/1908 | Siebert, Jr. | |
| 1,654,888 | A * | 1/1928 | King | 601/13 |
| 2,708,928 | A | 5/1955 | Zenatti | |
| 2003/0088241 | A1 * | 5/2003 | Hasegawa | 606/28 |

FOREIGN PATENT DOCUMENTS

| | | | |
|---|---|---|---|
| CA | 2408863 | A1 | 5/2003 |
| CN | 1047448 | | 12/1990 |
| CN | 2376907 | | 5/2000 |
| CN | 2393510 | Y | 8/2000 |
| CN | 2430152 | | 5/2001 |
| CN | 2524721 | | 12/2002 |
| CN | 2601087 | | 1/2004 |

OTHER PUBLICATIONS

English Translation of Foreign Patent CN 2376907, 5 pages, May 10, 2000.

English Translation of Foreign Patent CN 1047448, 4 pages, Dec. 5, 1990.

American Academy of Ophthalmology, Complementary Therapy Assessment Visual Training for Refractive Errors, www.aao.org, Oct. 21, 2004.

* cited by examiner

MYOPIA THERAPY APPLIANCE AND A BLINDER WITH SAID APPLIANCE

FIELD OF THE INVENTION

The invention relates to a myopia prophylactic and therapy appliance. More specifically, it is an improvement of myopia therapy appliances currently available.

BACKGROUND OF THE INVENTION

Many measures, such as electrical impulses, acupuncture, presbyopic glasses and vibration massage, have been tried for myopia prophylaxis and therapy in order to get rid of the inconvenience and suffering caused by myopia. Though these measures help to some extent, they are not very effective. For example, there is a blinder available for myopia therapy by massaging the eyeball with a massage-head. Since the eyelid and the eyeball are separate and lubricated with tears, when the massage-head revolves against the eyelid, the eyelid follows but the eyeball does not, which is unlike the relationship of skin and muscle in which muscle follows the movement of the skin since they are bound together. Therefore, the massage is not effective, that is, the eyelid will hurt and suffer with strong massage and it does not help with light massage.

SUMMARY OF THE INVENTION

An object of the invention is to provide a more effective myopia therapy appliance and a blinder therewith, and to solve the problems that the massage is not effective, and the eyelid will hurt and suffer with strong massage and it does not help with light massage.

In order to achieve the above purpose, the inventive myopia therapy appliance includes a suction head and a handle. The end of the suction head comprises a round, flat, smooth opening. A blowhole is set on the wall of the handle.

In one embodiment of the invention, the end of the suction head is an intrados to fit the eyeballs snugly or tightly, that is to match the shape of the eyes.

In another embodiment, the suction head is more than 8 mm deep to avoid contact with eyelashes.

In yet another embodiment, the diameter of the suction head is between 10 mm and 35 mm.

According to another aspect of the invention, the myopia therapy appliance described above is installed on a blinder, which includes a concave opaque cover with an elastic strap. The handle of the appliance is detachably installed on the cover to avoid possible detachment of the suction head from the handle when the appliance is pushed back and forth.

Many advantages and positive effects have been achieved in the invention. During the course of using the appliance, first, put the suction head snugly on the eyeball. A snug fit is required in order to vent the air out of the suction head and thereby partly expel the air inside. Covering, or nipping, the blowhole in the handle produces minus, or negative, air pressure. Thus, negative pressure is produced in the suction head by nipping the blowhole. Lastly, (because of the negative pressure between the eyelid and eyeball,) the suction head sucks the eyelid and the eyeball, and moves back and forth by pulling forward and pushing backward the handle. As the eyeball is controlled by six extraocular muscles, when the handle is pulled forward, a slight fore-and-aft distortion happens to the eyeball because of the movement of the extraocular muscles; when the handle is pushed backward, a right-and-left distortion happens to the eyeball because of the barrier of orbit bones. Therefore strong massage can be achieved to the spasmodic ciliary muscle in the eyeball by the two directional distortions of the eyeballs so that the ciliary muscle can soon be relaxed and return to regulate normally and to restore eye adjustability. Since the extraocular muscles are also massaged when the eyeball moves back and forth, dragging the six extraocular muscles to move back and forth, fatigue can be gotten rid of in the entire eye. Therefore, the invention is effective, easy to use and manufacture, and inexpensive. In addition, the invention also helps in treatment for strabismus and hyperopia.

Figure 2:
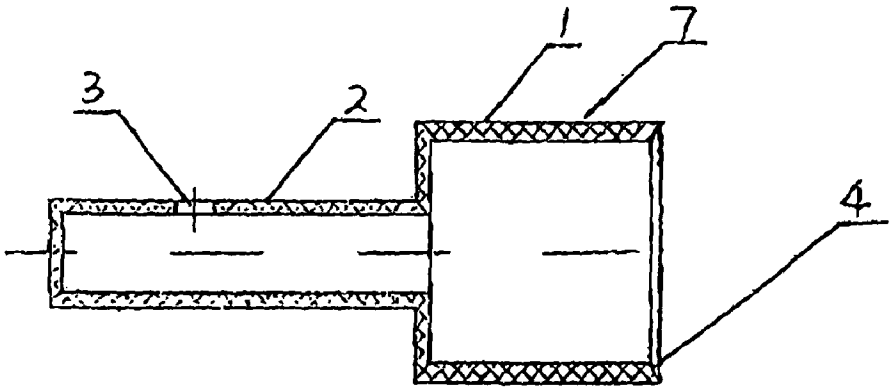
FIG. 2 is a side view of the appliance in FIG. 1.

The following is a list of the reference numerals of the parts of the invention shown in the Figures:

1 suction head;
2 handle;
3 blowhole;
4 intrados;
5 blinder;
6 elastic strap;
7 myopia therapy appliance.

DETAILED DESCRIPTION OF THE PREFERRED EMBODIMENT

Figure 1:
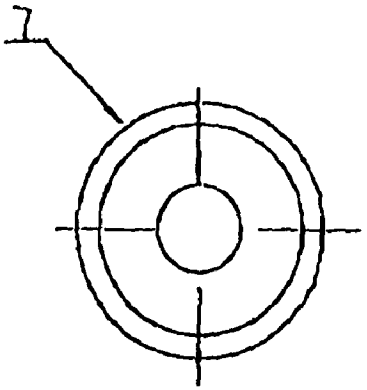
FIG. 1 is a sectional view of an appliance according to one embodiment of the invention.

Referring to FIGS. 1-2, the inventive myopia therapy appliance includes a suction head (or tip) 1 and a handle 2. The end of the suction head is in the form of a round flat opening. In other words, the tip end is a smooth round opening. A blowhole 3 is set on the wall of the handle 2. The end of the suction head 1 is an intrados 4 to fit the eyeballs snugly, or tightly. In other words, the intrados 4 is at the tip end, so it can be held closely to the eyes. The suction head 1 is more than 8 mm deep to avoid contact with eyelashes during use. The diameter of the suction head 1 is between 10 mm and 35 mm. The diameter of the handle 2 may be less than or equal to, that of the suction head 1. In addition, the myopia therapy appliance 7 is made of opaque material in order to facilitate relaxation of the eye in the dark during treatment.

Figure 3:
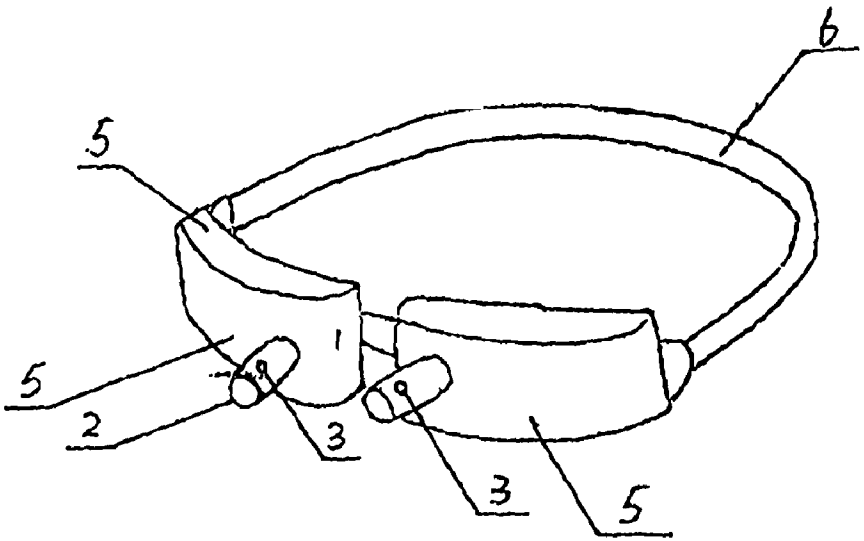
FIG. 3 is a perspective view of the appliance in FIG. 1 installed on a blinder.

Referring to FIG. 3, in another embodiment of the invention, a myopia therapy appliance is installed on a blinder, and the blinder includes a concave opaque cover 5 with an elastic strap 6. The myopia therapy appliance 7 is detachably installed on the cover 5. The myopia therapy appliance 7 includes a suction head 1 and a handle 2. The end of the suction head is in the form of a round flat open. A blowhole 3 is set on the wall of the handle 2. The end of the suction head 1 is an intrados 4 to fit the eyeballs snugly, or tightly. The suction head 1 is more than 8 mm deep to avoid contact with eyelashes during use. The diameter of the suction head 1 is between 10 mm and 35 mm. The diameter of the handle 2 may be less than, or equal to, that of the suction head 1. In addition, both the myopia therapy appliance 7 and the cover 5 can be made of opaque material in order to let the eyes have a relaxed treatment.

The above description is not to be considered as limiting the scope to the precise embodiments described herein, nor the embodiments as limiting the scope of the invention. Equivalents will be known and understood to persons skilled in the art. Many modifications, alterations, additions, and substitutions can be made by those skilled in the art, without departing from the scope of the invention as defined in the appended claims.

What is claimed is:

1. A blinder having a myopia therapy appliance installed thereon, the blinder comprising a concave opaque cover connected to an elastic strap, and the myopia therapy appliance detachably installed on the cover, the myopia therapy appliance comprising a suction head having a concave interior of a configuration to cooperatively engage a person's eye and having an inner opening which communicates with a cavity of a handle that is aligned with and extends from the suction head such that the handle is engaged to apply pushing and pulling forces to the suction head when the suction head is in engagement with an eye, an outer end of the suction head defining a round flat opening to rest over the eye, and a blowhole through a sidewall of the handle.

2. The blinder having a myopia therapy appliance installed thereon of claim 1, wherein the outer end of the suction head is in configuration of an intrados.

3. The blinder having a myopia therapy appliance installed thereon of claim 2, wherein a diameter of the outer end of the suction head is between 15 mm and 30 mm.

4. The blinder having a myopia therapy appliance installed thereon of claim 2, wherein the suction head is more than 8 mm in depth.

5. The blinder having a myopia therapy appliance installed thereon of claim 1, the suction head is more than 8 mm in depth.

6. The blinder having a myopia therapy appliance installed thereon of claim 5, wherein a diameter of the outer end of the suction head is between 15 mm and 30 mm.

7. The blinder having a myopia therapy appliance installed thereon of claim 1, wherein a diameter of the outer end of the suction head is between 15 mm and 30 mm.

* * * * *